United States Patent [19]

Trimble

[11] Patent Number: 4,531,029

[45] Date of Patent: Jul. 23, 1985

[54] CRICKET SWITCH

[76] Inventor: Currillies Trimble, 17912 Invermere Rd., Cleveland, Ohio 44128

[21] Appl. No.: 521,061

[22] Filed: Aug. 8, 1983

Related U.S. Application Data

[63] Continuation of Ser. No. 338,076, Jan. 8, 1982, abandoned.

[51] Int. Cl.[3] ..... H01H 3/16

[52] U.S. Cl. ..... 200/61.62; 200/61.81; 340/545

[58] Field of Search ..... 200/61.62, 61.66, 61.67, 200/61.71-61.75, 61.76-61.83, 153 T; 335/167, 170; 340/545, 547

[56] References Cited

U.S. PATENT DOCUMENTS

| | | | |
|---|---|---|---|
| 465,602 | 12/1881 | Thompson | 200/61.72 |
| 1,455,763 | 5/1923 | Werner | 340/545 X |
| 2,436,470 | 2/1948 | Fleming | 200/61.82 X |
| 2,600,581 | 6/1952 | Schenendorf | 200/61.62 X |
| 2,734,123 | 2/1956 | Gerber | 200/61.82 X |
| 2,924,682 | 2/1960 | Winterburn | 200/61.62 |
| 3,091,760 | 5/1963 | Spenard et al. | 340/545 X |
| 3,571,544 | 3/1971 | Sheehan | 200/157 |
| 3,710,369 | 1/1973 | Takahashi | 340/547 |
| 4,057,773 | 11/1977 | Cohen | 335/205 |

*Primary Examiner*—J. R. Scott

*Attorney, Agent, or Firm*—Woodling, Krost, Rust & Hochberg

[57] ABSTRACT

An automatically resetting alarm switch includes a casing which may be mounted into a stationary frame of a window or other closure. The casing has a side opening through which a contact head protrudes. The contact head is connected to an internally located trip lever which, in turn, is in contact with a microswitch. A solenoid having a plunger also is disposed within the casing. The plunger is capable of shifting the trip lever. The contact head is coupled frictionally to a sliding surface of the closure. Upon movement of the closure, the contact head is moved which causes the microswitch to trigger a remotely located alarm device. The solenoid also is activated and the resultant movement of the plunger resets the contact head in readiness for sending another alarm signal.

11 Claims, 4 Drawing Figures

CRICKET SWITCH

This is a continuation of application Ser. No. 338,076, filed Jan. 8, 1982 now abandoned.

BACKGROUND OF THE INVENTION

1. Field of the Invention

The invention relates to switches for electrically operated alarm devices and, in particular, to an automatically resetting switch for such devices.

2. Description of the Prior Art

Most switches presently used in burglar alarm systems employ actuating elements which operate without physical, direct contact with other components of the switch. For example, many prior switches include magnetically operated reed-type switching means wherein an alarm is actuated in response to opening of a closure such as a window or door when a magnet becomes displaced from a fixed position relative to the switch. Such arrangements usually employ a normally open switch that becomes closed due to proximity of the magnet. These switches usually operate as a two position switching means characterized by the need to move the closure relative to the switch in order to reset the switch. It is believed that there is no simple, automatically resetting electro-mechanical switch commercially available at the present time. Therefore, a principal object of the present invention is to provide an automatically resetting alarm switch.

Another object of the present invention is to provide an automatically resetting switch that is simple to install and which requires little maintenance, if any, to insure proper operation with extended service life. A further object of the present invention is to provide an automatically resetting switch that permits triggering of alarm circuitry regardless of the position of the closure. Still another object of the present invention is to provide an automatically resetting switch that employs a magnetic head in physical contact with a ferritic plate so as to allow multiple-position operation.

SUMMARY OF THE INVENTION

In order to accomplish the foregoing objectives, the present invention provides a new and improved automatically resetting alarm switch wherein a contact head protrudes outwardly of a casing. The casing can be secured to a closure such as a window or door, or to a stationary frame within which the closure is disposed for movement.

A ferritic plate can be secured to the other relatively movable member. The casing is arranged relative to the plate such that the contact head is in constant contact with the plate during movement of the closure. In a preferred embodiment, the head is spring-biased into contact with the plate.

Upon movement of the closure, the interaction of the contact head and the plate causes the head to move which, in turn, causes a microswitch disposed within the casing to trigger an alarm device. A means for resetting the contact head to a rest position also is provided. The means for resetting is in the form of a solenoid having a plunger disposed within the casing. The plunger is operatively connected to the contact head. The solenoid is connected to the microswitch such that, upon switching of the microswitch due to movement of the contact head from the rest position, the solenoid is activated. The resultant movement of the plunger resets the contact head in readiness for sending other alarm signals. Accordingly, regardless of the position of the closure relative to its frame, the switch always will be ready to send an alarm signal and the switch always will be automatically reset after a previous alarm signal has been sent. The foregoing objects, features and advantages of the present invention will become more fully apparent from the following description of the preferred embodiment of the invention taken together with the accompanying drawings.

DESCRIPTION OF THE PREFERRED EMBODIMENT

Figure 1:
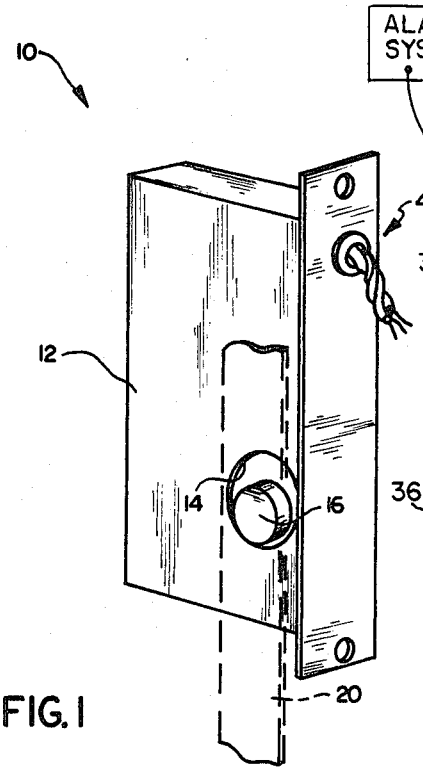
FIG. 1 is a perspective view of an automatically resetting alarm switch according to the invention.

Referring to FIG. 1, an automatically resetting alarm switch 10 includes a relatively small and compact casing 12 capable of being mounted into a stationary frame (not shown) of a closure such as a window or a door. The casing 12 also can be mounted on or in the closure, if desired. For purposes of simplicity, subsequent discussion will refer to the casing 12 as being mounted into the frame of the closure.

Figure 2:
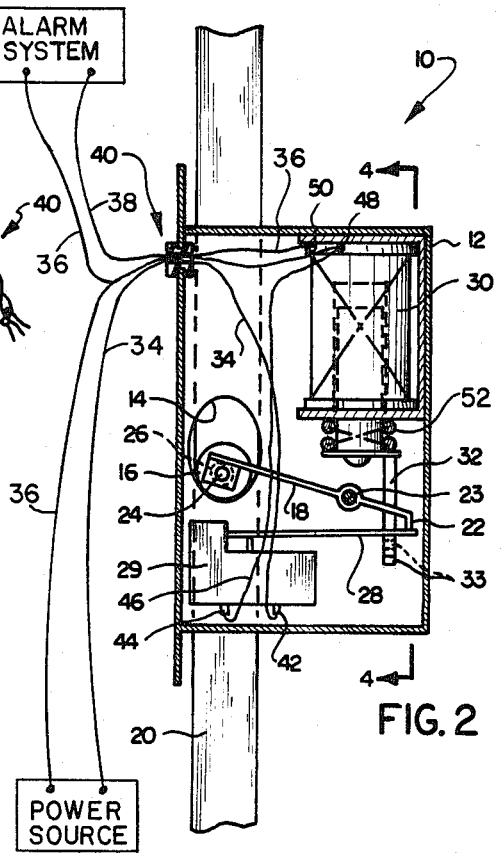
FIG. 2 is a cross-sectional interior view of the switch of FIG. 1 and showing the switch components in non-actuated position.
Figure 3:
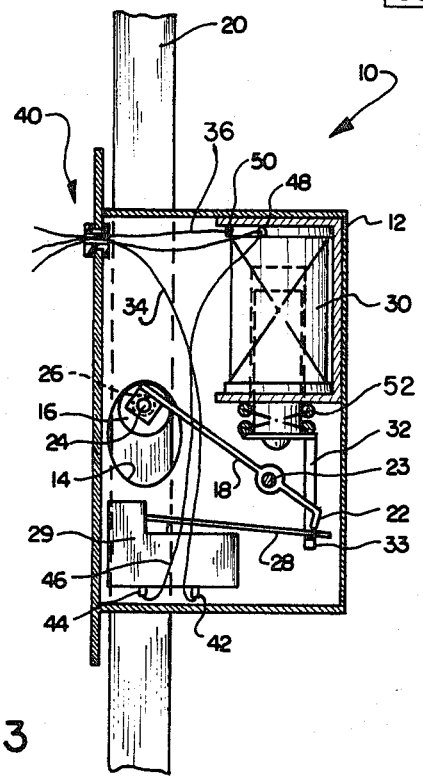
FIG. 3 is a cross-sectional interior view of the switch of FIG. 1, showing the switch components in an actuated position.
Figure 4:
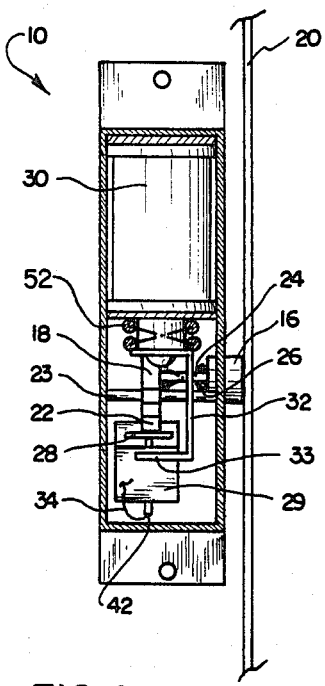
FIG. 4 is a view taken along a plane indicated by line 4—4 in FIG. 2.

The casing 12 is provided with a side opening 14 large enough to receive a movable, partially protruding contact head 16 of an internally located trip lever 18 (FIG. 2). The head 16 is capable of sliding directly in contact with the door or window or in contact with a ferritic track 20 secured to the closure. Referring to FIGS. 2 and 3, the trip lever 18 has one end which terminates with the head 16 and an opposite end 22. The lever 18 is pivotally mounted within the casing 12 by a shaft 23. The head 16 is mounted to the lever 18 by means of a shaft 24 and is biased toward the track 20 by a spring 26 disposed intermediate the head 16 and the lever 18. A movable contact arm 28 extends outwardly from a microswitch 29. The arm 28 is pivotally mounted in the microswitch 29 so as to be biased in the upward (or microswitch "normally-off") position as shown in FIG. 2. The arm 28 is engageable with the end 22 of the lever 18. A solenoid 30 is provided with a plunger 32 which terminates with a laterally projecting portion 33. The portion 33 is disposed adjacent the arm 28 and is capable of retracting both the trip lever end 22 and the arm 28 the instant the solenoid 30 is energized electrically. Leads 34, 36, 38 in a bundle identified by the reference numeral 40 are interconnected such that current flows into the microswitch 29, which is normally open, via lead 34 attached to a terminal 42. The microswitch 29 also includes a terminal 44 which becomes electrically activated upon movement of the contact arm 28 to the closed position. Terminal 44 feeds current to solenoid 30 via a lead 46 connected to a terminal 48 of the solenoid 30. Lead 36 is attached to a terminal 50 of the solenoid 30. Lead 38 is attached to the terminal 48 of the solenoid 30 along with lead 46 identified before. The other end of the lead 38 is connected to an alarm device (not shown), while the other end of the lead 36 is connected to an electrical ground (not shown).

In operation, movement of the window or door causes frictional drag between the contact head 16 and the track 20 and immediately closes the normally open contact of the microswitch 29 due to a downward motion of the arm 28 by the pivoted end 22 of the trip lever 18 (FIG. 3). In turn, current flows in leads 36, 38 so as to actuate the separate alarm device. At the same time, the bobbin coil of the solenoid 30 is energized by allowing current flow through terminal 44 into the lead 46. Simultaneously, the solenoid plunger 32 becomes magnetically pulled into the solenoid cavity. The laterally projecting portion 33 lifts both the microswitch arm 28 and the trip lever end 22 back to the original microswitch normally open position, discontinuing further current flow into the switch 10 and also resetting the contact head 16 in rest position against the track 20 for a subsequent operation. Means for maintaining the contact head 16 in rest position after the closure is opened could be effected by numerous expedients (springs, gravity, etc.) and, in the present instance, the solenoid 30 is used, as actuation of the solenoid occurs whenever the window is moved upward thus always maintaining the left end of the lever 18 (FIG. 2) in a downward or reset position.

It should be understood that although the contact head 16 can effectively work against any material such as that provided by the sides of windows or doors, in order to insure a more positive frictional drag between the contact head 16 and the track 20 and to improve reliability, a permanent magnet was selected for the contact head 16 coupled with a ferritic elongated metal track 20 which may be painted against corrosion and secured to a window sash (not shown) or the like. Further, in order to maintain the plunger 32 with the laterally projecting portion 33 in a disengaged position such as that shown in the solid line position in FIG. 2, a spring 52 is disposed about the plunger 32 so as to act against the solenoid 30.

While a particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention.

It is claimed:

1. A non-magnetic friction-actuated automatically resetting switch, comprising:

a casing for attachment to a selected one of two relatively movable components including a closure such as a door, a window, or the like and a stationary frame structure within which the closure is movable;

a contact head always protruding outwardly of the casing and always in contact with the closure, the contact head being movable relative to the casing in response to any opening movement of the closure, the contact head always being maintained in a rest position when the closure is not being moved;

a microswitch disposed within the casing, the microswitch being in contact with the contact head such that movement of the contact head from the rest position always results in switching of the microswitch; and means for resetting and maintaining the contact head to the rest position whenever the closure is moved in an opening direction, the means for resetting operating after the contact head has been moved from its rest position, and when the closure is stopped in any position after being moved in an opening direction.

2. The switch of claim 1, wherein the contact head is operationally connected to the microswitch by a pivotally mounted lever disposed within the casing, said contact head being mounted on one end of the lever and the other end of the lever being in operational contact with the microswitch.

3. The switch of claim 1, wherein the microswitch is normally open and is closed in response to movement of the contact head from the rest position.

4. The switch of claim 1, further comprising:

a ferritic track structure directly secured by suitable means to the other of the relatively movable components than that to which the casing is secured, the track being disposed on said other of the relatively movable components in a position whereby it is adjacent the contact head such that the contact head frictionally engages the track during movement of the closure and the contact head is formed of a magnetic material.

5. The switch of claim 1, wherein the means for resetting is in the form of a solenoid from which a plunger extends, the plunger engaging a portion of the contact head such that, upon activation of the solenoid, the plunger moves the contact head to the rest position.

6. The switch of claim 1, wherein;

a first electrical lead is connected to the microswitch, the first electrical lead adapted to carry an associated supply of electrical current;

a second electrical lead is connected between the microswitch and the means for resetting, the second electrical lead adapted to carry electrical current upon activation of the microswitch;

a third electrical lead is connected to the means for resetting and an associated alarm device, the third electrical lead adapted to carry said associated supply of electrical current upon activation of the microswitch; and a fourth electrical lead is connected to the means for resetting, the fourth electrical lead being connected to an associated electrical ground.

7. The switch of claim 1, and further including contact head bias means wherein the contact head is biased into frictional engagement with the other of the relatively movable components than that to which the casing is secured.

8. The switch of claim 1, wherein;

a first electrical lead is connected to the microswitch, the first electrical lead adapted to carry an associated supply of electrical current;

a second electrical lead is connected between the microswitch and the means for resetting, the second electrical lead carrying the electrical current upon activation of the microswitch;

a third electrical lead is connected to the means for resetting and an associated alarm device, the third electrical lead carrying a supply of the electrical current upon activation of the microswitch; and a fourth electrical lead is connected to the means for resetting, the fourth electrical lead being connected to an associated electrical ground.

9. A non-magnetic friction-actuated automatically resetting switch comprising;

a casing for attachment to a selected one of two relatively movable components including a closure such as a door, a window, or the like and a stationary frame structure within which the closure is movable;

a contact head always protruding outwardly of the casing and having a contact head lever pivotally mounted within the casing, the lever carrying the contact head at one end of the lever, the contact head being movable relative to the casing in response to movement of the closure, the contact head always being in contact with the closure and always being maintained in a rest position when the closure is not being moved;

a microswitch disposed within the casing and having a microswitch arm that switches the microswitch on and off, said microswitch also having bias means to bias the arm upwardly to an "off" position, the microswitch arm being in operative contact with the other end of the contact head lever such that movement of the contact head from the rest position always results in switching of the microswitch; and a solenoid disposed within the casing, the solenoid having a plunger operatively engaging the microswitch arm which in turn engages the lever such that, upon activation of the solenoid, the plunger moves the contact head to the rest position.

10. The switch of claim 9, further comprising;

a ferritic track structure directly secured by suitable means to the other of the relatively movable components than that to which the casing is secured, the track being disposed on said other of the relatively movable components in a position whereby it is adjacent the contact head such that the contact head frictionally engages the track during movement of the closure; and the contact head is formed of a magnetic material.

11. The switch of claim 9, and further including contact head bias means wherein the contact head is biased into frictional engagement with the other of the relatively movable components than that to which the casing is secured.

* * * * *